US007201337B1

(12) United States Patent
Feola

(10) Patent No.: US 7,201,337 B1
(45) Date of Patent: Apr. 10, 2007

(54) WASTE FOOD DISPOSER ACTIVATION CONTROL APPARATUS

(76) Inventor: John Feola, 5 Samuel Phelps Way, North Reading, MA (US) 01864

( * ) Notice: Subject to any disclaimer, the term of this patent is extended or adjusted under 35 U.S.C. 154(b) by 37 days.

(21) Appl. No.: 10/908,477

(22) Filed: May 13, 2005

(51) Int. Cl.
*E03C 1/266* (2006.01)
*E03C 1/26* (2006.01)

(52) U.S. Cl. ..... 241/32.5; 241/46.013; 241/46.014; 241/46.015; 241/46.016

(58) Field of Classification Search ..... 241/46.013, 241/46.014, 46.015, 46.016, 32.5
See application file for complete search history.

(56) References Cited

U.S. PATENT DOCUMENTS 3,425,637 A * 2/1969 Enright et al. ..... 241/32.5
3,430,871 A * 3/1969 Ross ..... 241/32.5
4,124,789 A * 11/1978 Preece ..... 241/32.5
2004/0178289 A1* 9/2004 Jara-Almonte et al. 241/46.016

* cited by examiner

*Primary Examiner*—Lowell Larson
*Assistant Examiner*—Jason Pahng
(74) *Attorney, Agent, or Firm*—Altman & Martin; Steven K. Martin

(57) ABSTRACT

A waste food disposer operation control apparatus that comprises a waste food disposer having an opening for accepting waste material, a flexible hose with a source end and a nozzle end with the source end operationally connected to a controllable water source, a nozzle operationally connected to the hose nozzle end with the nozzle adapted to be positioned in the disposer opening, and an activator means for activating the disposer when the nozzle is positioned in the disposer opening.

11 Claims, 4 Drawing Sheets

WASTE FOOD DISPOSER ACTIVATION CONTROL APPARATUS

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to waste food disposers, more particularly, to an apparatus for controlling operation of a waste food disposer.

2. Description of the Related Art

Under-sink waste food disposers are common household appliances. There are two basic types of disposers: continuous feed and batch feed. In a continuous feed disposer, the unit is turned on by a remote wall switch before inserting the waste. The waste is inserted in small quantities as the disposer is running until there is no more. In a batch feed disposer, a load of waste is inserted into the grind chamber and the motor is started by placing a stopper down into the mouth of the drain flange. Typically, the stopper has a permanent magnet that is sensed when the stopper is inserted into the drain, either starting the disposer, thereby starting the motor.

There are several shortcomings to the batch feed disposer. First, the disposer cannot run without the stopper, making the stopper indispensable. Unfortunately, the stopper is not attached to anything, so it can be misplaced or lost, rendering the disposer useless. Second, a disposer relies on a lot of water to turn the food bits into a slurry that can be easy flushed through to the drain. With a stopper, the flow of water into the disposer may be restricted, resulting in less than optimal performance of the disposer.

BRIEF SUMMARY OF THE INVENTION

An object of the present invention is to provide an operation control apparatus for waste food disposers that is always available and that does not restrict the flow of water into the disposer.

The present invention is a waste food disposer operation control apparatus that comprises a waste food disposer having an opening for accepting waste material, a flexible hose with a source end and a nozzle end with the source end operationally connected to a controllable water source, a nozzle operationally connected to the hose nozzle end with the nozzle adapted to be positioned in the disposer opening, and an activator means for activating the disposer when the nozzle is positioned in the disposer opening.

Pull-out faucets, side sprays, and spring faucets are well-known. Essentially, these have a flexible hose with a nozzle at the end. The flexible hose permits a person to move the nozzle around the sink area as desired. For the present invention, a mechanism for controlling the activation of the disposer is incorporated into the nozzle and disposer such that the nozzle must be positioned in the disposer opening in order to activate the disposer.

There are a number of such mechanisms known in the art, any and all of which are contemplated for use by the present invention. A relatively common mechanism integrates a permanent magnet into the side of the nozzle and positions a magnetic sensor adjacent to the disposer opening. When the nozzle is inserted into the opening, the sensor senses the presence of the magnet, which activate the disposer.

Optionally, the nozzle-activated mechanism is in series with a wall switch. Optionally, the nozzle-activated mechanism is in series with a water-flow sensor so that the water must be turned on to a predetermined minimum volume. Optionally, the faucet includes a mechanism that turns the water on to a predetermined minimum volume when the nozzle is inserted into the disposer opening.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying figure, wherein.

DETAILED DESCRIPTION OF THE INVENTION

The present invention is an apparatus for controlling the operation of a batch-type waste food disposer while simultaneously supplying the water needed to flush the ground food particles. The basic apparatus is a pull-out faucet nozzle that is shaped to fit into the sink drain.

Figure 1:
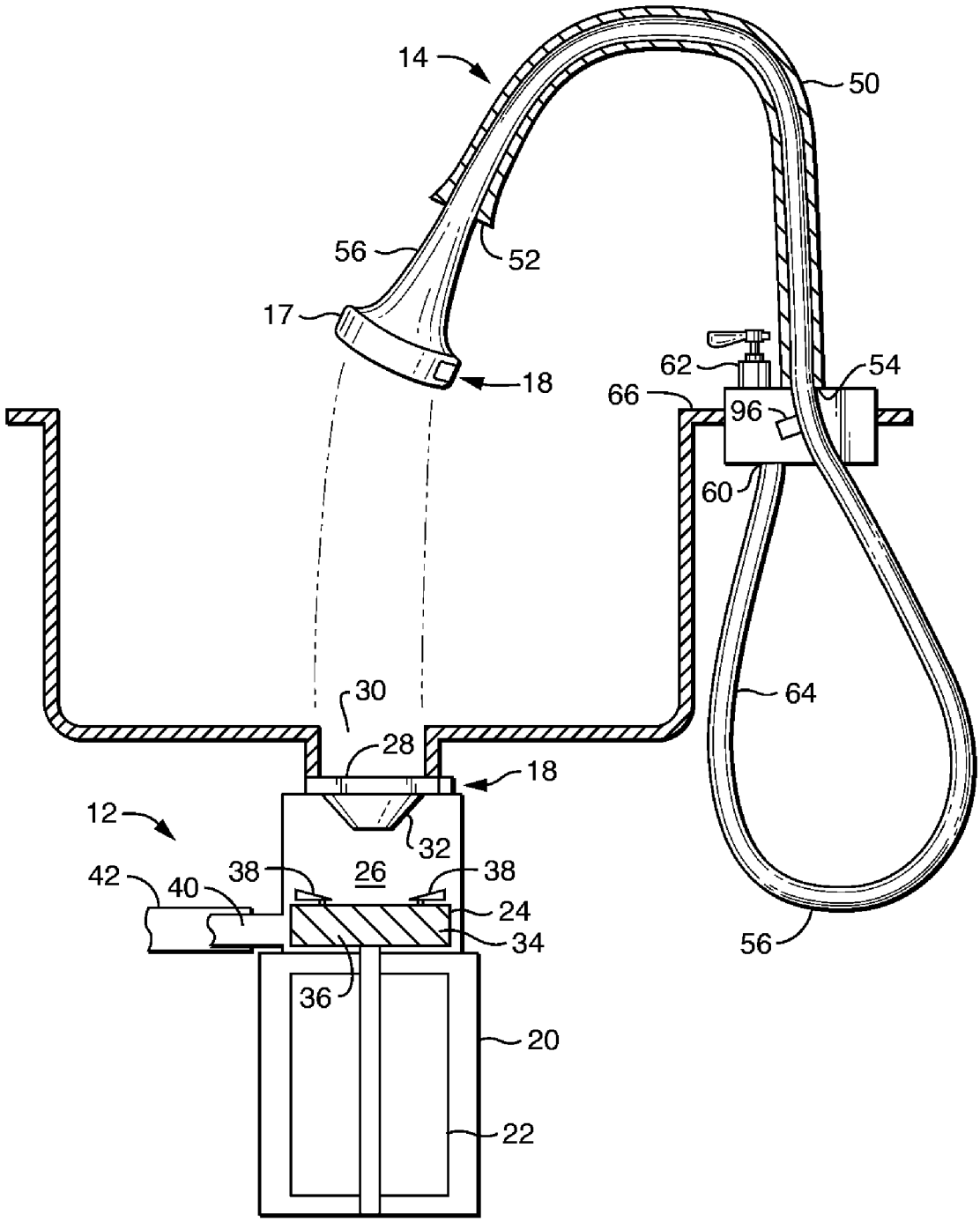
FIG. 1 is a cross-section of the pull-out faucet embodiment of the waste food disposer operation control apparatus of the present invention.

A common batch feed waste disposer 12 is shown in FIG. 1. The disposer 12 has a housing 20 in which resides an electric motor 22 that spins a turntable 24 in a grind chamber 26. An opening 28 in the top of the disposer 12 mounted in the sink drain 30 provides access for inserting waste into the grind chamber 26. A flexible shield 32 inhibits waste from being thrown back through the opening 28. Waste in the grind chamber 26 is flung outwardly by the turntable 24 against a series of cutting teeth 34 on a grind ring 36 around the perimeter. Slingers 38 on the turntable 24 are located near the edge and assist in keeping the waste spinning against the grind ring 36. The grind ring 36 reduces the waste into particles about the size of rice grains. The ground particles are flushed by running water through the disposer outlet 40 and into a drain line 42. This flushing is important to prevent a buildup of residue in the disposer 12, as well as in the drain line 42.

Pull-out faucets are well-known. A basic pull-out faucet 14, shown in FIG. 1, has a curved, hollow body 50 with an open top end 52 and an open bottom end 54 attached to the sink rim 66. A flexible hose 56 extends from a water supply 60 into the bottom end 54 and through the top end 52, with a loop 64 between the water supply and bottom end 54. A nozzle 17 is attached to the free end of the hose 56. The top end 52 of the body 50 is shaped to allow the nozzle 17 to seat within the body 50. As the nozzle 17 is pulled from the top end 52, the hose 56 slides through the body 50. Generally, a biasing mechanism (not shown) returns the nozzle 17 to the top end 52 when the pulling force is removed from the nozzle 17. The water supply 60 includes a knob 62 or other mechanism for controlling the flow of water from the nozzle 17.

Figure 2:
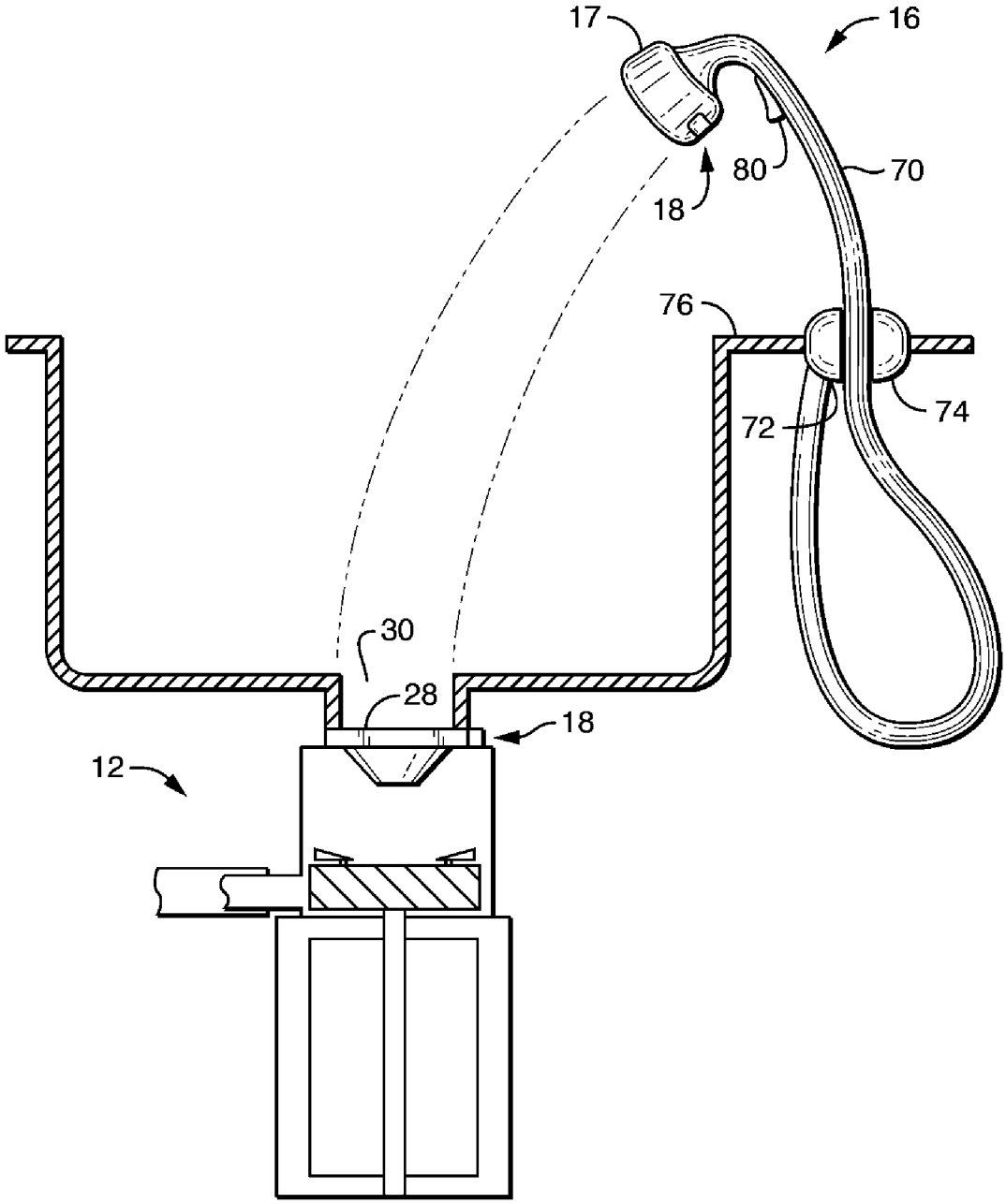
FIG. 2 is a cross-section of the side spray embodiment of the waste food disposer operation control apparatus of the present invention.

Also well-known are side sprays 16. The basic side spray 16, shown in FIG. 2, has a flexible hose 70 extending from a water supply 72 through a cup 74 in the sink rim 76 to a spray nozzle 17 that seats in the cup 74 when not in use. In use, the nozzle 17 is pulled from the cup 74 and the water is controlled by a trigger 80.

Figure 3:
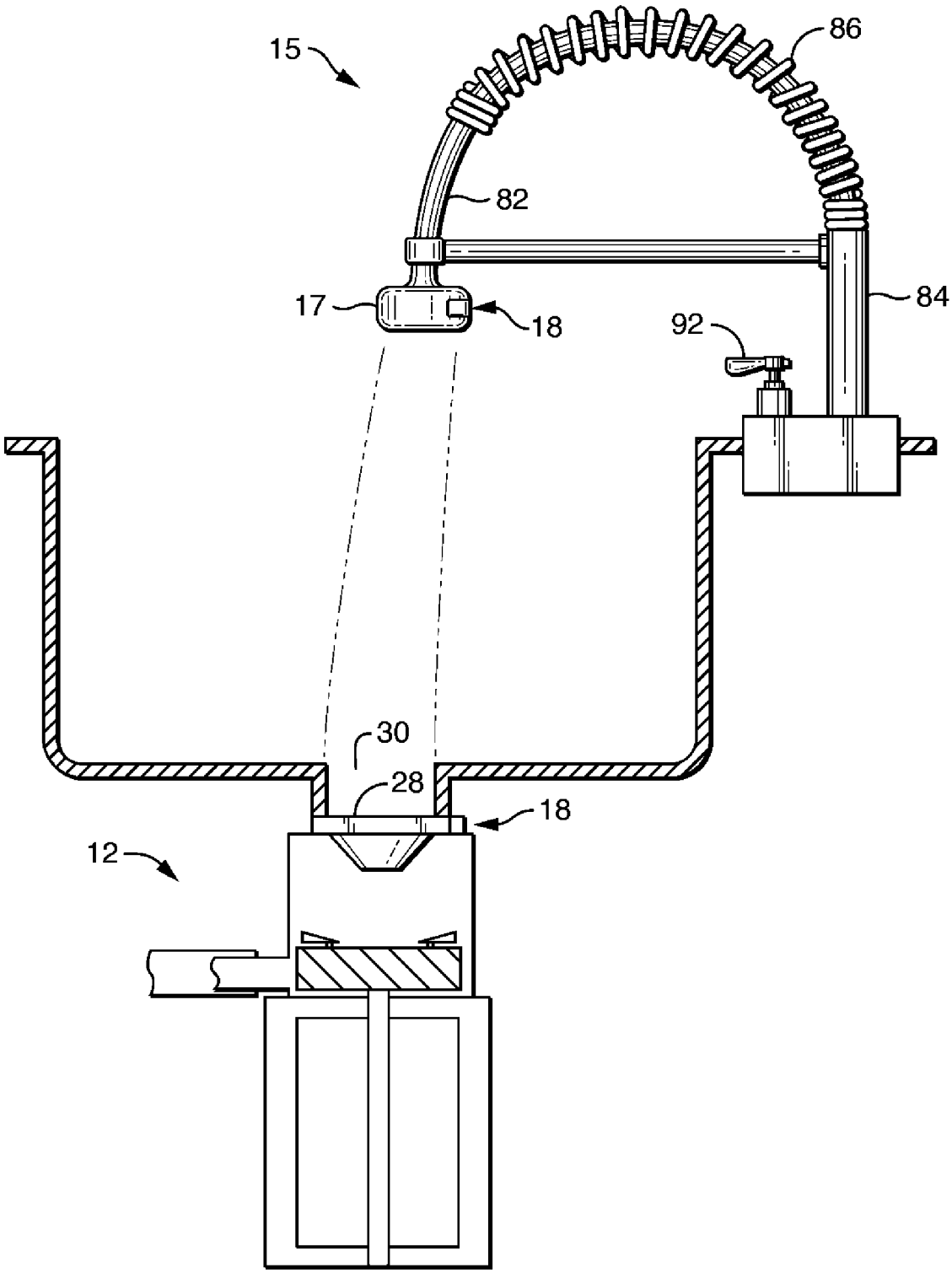
FIG. 3 is a cross-section of the spring faucet embodiment of the waste food disposer operation control apparatus of the present invention.

Another type of faucet with a flexible hose is the spring faucet 15 shown in FIG. 3. The spring faucet 15 has a flexible hose 82 extending from a rigid stem 84 through a spring 86. The nozzle 17 at the end of the hose 82 clips into a rigid arm 90. In use, the nozzle 17 is unclipped from the arm 90 and can be pulled toward the disposer opening 28. The water to the nozzle 17 is controlled by a knob 92 or other mechanism. When released, the spring 86 acts as a biasing mechanism to return the nozzle 17 to the vicinity of the arm 90, to which it can be reclipped.

Although the present invention is described as being implemented with pull-out faucets, side sprays, and spring faucets, it is understood that other configurations of nozzles on flexible hoses can be employed.

In the present invention, the disposer 12 and nozzle 17 of the prior art are modified by adding a mechanism for controlling the operation of the disposer 12, requiring that the nozzle 17 be positioned in the disposer opening 28 before the disposer 12 will operate. Optionally, a twist-lock design holds the nozzle 17 in the opening 28 so that the user does not have to continuously pull against any biasing mechanism that returns the nozzle 17 to its normal position.

Figure 4:
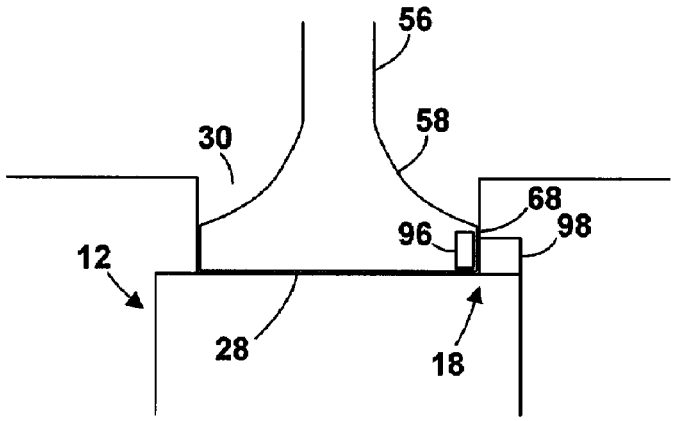
FIG. 4 is a close up view of the permanent magnet embodiment of the disposer controller.

There are a number of mechanisms 18 known in the art to control a waste disposer 12 by inserting a stopper into the disposer opening 28. Any one or more of these same mechanisms 18 can be incorporated into the nozzle 17 and disposer opening 28 of the present invention. In a relatively common mechanism, shown in FIG. 4, a permanent magnet 96 is integrated into the side 68 of the nozzle 17 and a magnetic sensor 98 is positioned adjacent to the disposer opening 28. When the nozzle 17 is inserted into the opening 28, the sensor 98 senses the presence of the magnet 96, which drives a circuit to activate the disposer 12. A different mechanism positions an inductive sensor in the disposer opening 28 so that when the metallic nozzle 17 is inserted into the opening 28, the sensor activates the disposer 12. Another mechanism is a mechanical switch in the opening 28 that is activated by inserting the nozzle 17.

Figure 5:
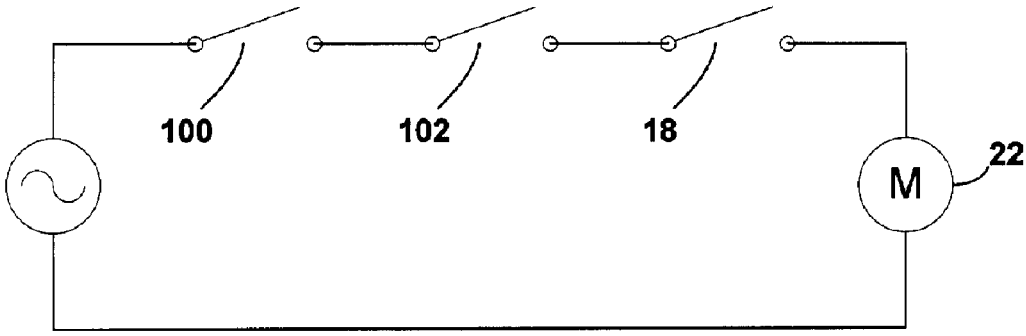
FIG. 5 is a block diagram of the basic control circuit of the present invention with optional enhancements.

Optionally, as shown in FIG. 5, the nozzle-activated mechanism 18 is in series with a wall switch 100 so that the disposer 12 is only started when both the nozzle 17 is seated in the disposer opening 28 and the wall switch 100 is activated.

Optionally, as shown in FIGS. 1 and 5, the nozzle-activated mechanism 18 is in series with a water-flow sensor 102 so that the disposer 12 is only started when both the nozzle 17 is seated in the disposer opening 28 and the water is turned on to a predetermined minimum volume. This configuration ensures that there is enough water flow for optimal operation of the disposer 12.

Optionally, the faucet includes a mechanism that turns the water on to a predetermined minimum volume when the nozzle 17 is inserted into the disposer opening 28, ensuring that the water is running when the disposer 12 is activated.

Thus it has been shown and described a waste food disposer operation control apparatus which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A waste food disposer operation control apparatus comprising:

(a) a waste food disposer having an opening for accepting waste material (b) a flexible hose with a source end and a nozzle end, said source end being operationally connected to a controllable water source;

(c) a nozzle operationally connected to said hose nozzle end, said nozzle being adapted to be positioned in said disposer opening; and (d) an activator means for activating said disposer when said nozzle is positioned in said disposer opening.

2. The waste food disposer operation control apparatus of claim 1 wherein said hose is a component of a faucet.

3. The waste food disposer operation control apparatus of claim 1 wherein said hose is a component of a side spray.

4. The waste food disposer operation control apparatus of claim 1 wherein said activator means includes a permanent magnet mounted in said nozzle and a magnet sensor mounted in said disposer opening.

5. The waste food disposer operation control apparatus of claim 1 wherein said activator means includes a water flow sensor.

6. The waste food disposer operation control apparatus of claim 1 wherein said activator means includes a wall switch.

7. A waste food disposer operation control apparatus adopted for use with a waste food disposer having an opening for accepting waste material and a sensor for activating said disposer when a stopper is positioned in said opening, said apparatus comprising:

(a) a flexible hose with a source end and a nozzle end, said source end being operationally connected to a controllable water source;

(b) a nozzle operationally connected to said hose nozzle end, said nozzle being adapted to be positioned in said disposer opening; and (c) an activating device within said nozzle for activating said disposer when sensed by said sensor when said nozzle is positioned in said disposer opening.

8. The waste food disposer operation control apparatus of claim 7 wherein said hose is a component of a faucet.

9. The waste food disposer operation control apparatus of claim 7 wherein said hose is a component of a side spray.

10. The waste food disposer operation control apparatus of claim 7 wherein said activating device is a permanent magnet.

11. The waste food disposer operation control apparatus of claim 7 further comprising a water flow sensor.

* * * * *